United States Patent [19]

Ohno et al.

[11] Patent Number: 5,046,927

[45] Date of Patent: Sep. 10, 1991

[54] WOBBLE PLATE TYPE VARIABLE CAPACITY COMPRESSOR WITH A CAPACITY DETECTOR

[75] Inventors: Junichi Ohno; Chuichi Kawamura; Kazuya Kimura, both of Kariya, all of Japan

[73] Assignee: Kabushiki Kaisha Toyoda Jidoshokki Seisakusho, Aichi, Japan

[21] Appl. No.: 518,655

[22] Filed: May 3, 1990

[30] Foreign Application Priority Data

May 10, 1989 [JP] Japan ..... 1-116592

[51] Int. Cl.[5] ..... F04B 1/26; F04B 1/12

[52] U.S. Cl. ..... 417/222 S; 417/269

[58] Field of Search ..... 417/222, 269, 222 S

[56] References Cited

U.S. PATENT DOCUMENTS

| | | | |
|---|---|---|---|
| 4,393,966 | 7/1983 | Kono | 417/269 |
| 4,712,982 | 12/1987 | Inagaki | 417/222 S |
| 4,732,545 | 3/1988 | Ohta | 417/222 S |
| 4,737,079 | 4/1988 | Kurosawa | 417/223 |
| 4,747,754 | 5/1988 | Fujii et al. . | |
| 4,822,252 | 4/1989 | Ishikawa | 417/222 S |
| 4,891,737 | 6/1989 | Fujii | 417/222 S |

FOREIGN PATENT DOCUMENTS 62-218670 9/1987 Japan .

*Primary Examiner*—Leonard E. Smith

*Assistant Examiner*—Peter Korytnyk

*Attorney, Agent, or Firm*—Burgess, Ryan and Wayne

[57] ABSTRACT

A variable capacity wobble plate type compressor having a non-rotatory wobble plate supported on a magnetic material support member to non-rotatively wobble to move compressing pistons in cylinder bores, a steel drive shaft driven by a drive source via a solenoid-operated clutch and causing the non-rotative wobble of the wobble plate at a given angle of inclination that is changed to vary the capacity of the compressor, and a capacity detecting unit provided with a permanent magnet attached to an outer periphery of the wobble plate, a magnetic sensor fixedly attached to the crankcase of the outer casing, for sensing an approach and departure of the permanent magnet of the wobble plate. The magnetic sensor generates electric signals indicating the approach and departure of the permanent magnet of the wobble plate, and a binary circuit electrically connected to the magnetic sensor converts the electric signals of the magnetic sensor into electric binary signals by which the capacity of the compressor is determined. The capacity detecting unit is also provided with an arrangement wherein a magnetic flux delivered from the permanent magnet flows in a direction opposite to that of a magnetic flux leaking from the solenoid-operated clutch through the drive shaft and the support member to prevent erroneous electric binary signals when the permanent magnet attached to the wobble plate is close to the magnetic sensor.

4 Claims, 3 Drawing Sheets

WOBBLE PLATE TYPE VARIABLE CAPACITY COMPRESSOR WITH A CAPACITY DETECTOR

BACKGROUND OF THE INVENTION

1. Field of the Invention

The present invention relates to a variable capacity wobble plate type refrigerant compressor capable of varying a capacity of a compression of a refrigerant gas by varying the reciprocation strokes of compressing pistons by changing an angle of inclination of a non-rotatably inclinable wobble plate supported by a drive plate rotating with a drive shaft when the drive shaft is driven by an external drive source, such as a vehicle engine, via a solenoid-operated electro-magnetic clutch. More particularly, the present invention relates to the above-defined type of refrigerant compressor provided with a highly accurate capacity detector generating electric signals indicating a precise current capacity at which the compressor is currently operated.

2. Description of the Related Art

A variable capacity wobble plate type compressor with a solenoid-operated wobble angle control valve is disclosed, for example, in U.S. Pat. No. 4,747,754 to Fujii et al. The solenoid-operated wobble angle control valve of the compressor of U.S. Pat. No. 4,747,754 is incorporated in a compressor head to promote a smooth and quick change of wobble angle of a wobble plate within a crankcase connected to the compressor head, in response to a signal indicating a change in a refrigerating load.

Japanese Unexamined (Kokai) Patent Publication No. 62-218670, published on Sept. 26, 1987, discloses another variable capacity wobble plate type refrigerant compressor provided with a capacity detector which comprises an electro-magnetic induction type detecting device fixedly attached to an outer surface of a frame member of the compressor, and a pin-shape detected element attached to a wobble plate. When the compressor is operated, the wobbling plate carries out a wobbling motion by which the detected element is reciprocably moved to pass the detecting device. The detecting device then generates an electric pulsive signal each time the device electro-magnetically sensed the passing of the element, and the electric pulsive signal is sent to a control unit to which the detecting device is electrically connected. The control unit thus detects a number of revolutions and an extent of the angle of wobbling of the wobble plate on the basis of the pulsive signals sent from the detecting device. More specifically, the control unit detects a time period $T_2$ for which the detected element is moved in one region arranged on one of the right and left sides with respect to the center of the detecting device, and a time period $T_1$ for which the detected element is moved in another region arranged on the other side, on the basis of the time interval between two adjacent electric pulsive signals. The control unit further calculates, from the detected $T_1$ and $T_2$, a ratio $T_1/T_2$ by which the strokes of the compressing pistons are detected, and therefore, the number of revolutions and the extent of the angle of wobbling of the wobble plate are detected, and as a result, the capacity of the compressor at the current operating condition thereof is detected.

Although Japanese Unexamined (Kokai) Patent Publication No. 62-218670 does not disclose the material used for the pin-like detected element, it will be obvious to a person skilled in the art that, when the detected element is a permanent magnet, the construction of the detected element per se and the detecting device is simple. Nevertheless, when an experiment was conducted by the inventors with respect to one example of a wobble plate type compressor provided with a capacity detector using a detected element made of a permanent magnet, it was found that electric signals, i.e., electric voltage signals output by a detecting device, contain noise, and accordingly, a train of electric pulsive signals derived from the electric voltage signals were inaccurate due to the existence of erroneous pulse signals in the train. Since both erroneous and true electric pulsive signals were sent to a control unit, the control unit generated erroneous information with regard to the compressor capacity to be sent to an electronic microcomputer controlling the overall operation of the wobble plate type compressor in response to various external signals, such as a cooling load, atmospheric temperature, and so on. When a further experiment was conducted to determine the cause of the generation of the above-mentioned erroneous information, it was found that a magnetic flux leaking from a solenoid clutch device mounted on the compressor end periodically acts on the detecting device via a steel drive shaft of the compressor and a steel support arm member for supporting a drive and wobble plate assembly on the drive shaft, to thereby cause the output of the unwanted electric voltage noise from the detecting device. A further explanation of this problem will be given below with reference to FIGS. 3A through 3C.

Note, the detecting device used for the experiment conducted by the present inventors comprised an electro-magnetic induction type magnetic-flux sensor and an electric binary circuit element for converting an output signal of the magnetic sensor into electric binary signals.

FIG. 3A indicates electric voltage signals output by the detecting device. As shown in FIG. 3A, signals denoted by Va' indicate valid voltage signals that are electric AC voltage signals output at one cycle per second (1.0 Hz) by the magnetic-flux sensor each time the sensor senses the permanent magnet attached to the wobble plate, and signals denoted by Vb' indicate invalid voltage signals that are electric AC voltage signals output by the magnetic-flux sensor each time the sensor senses an approach of the above-mentioned steel support arm member. The valid and invalid voltage signals Va' and Vb' are sent to the electric binary circuit, by which these signals Va' and Vb' are subjected to a binary conversion with respect to a threshold level corresponding to an electric zero voltage level, and accordingly, these signals Va' and Vb' are converted into electric pulsive signals Vk as illustrated by FIG. 3B. The electric pulsive signals Vk are further subjected to a frequency division to obtain output pulsive signals Vk, illustrated by FIG. 3C, to thereby simplify the post-processing of the signals Vk'. The output pulsive signals Vk, contain erroneous signals Vn derived from the invalid voltage signals Vb', and accordingly, generate inaccurate information on the current capacity of the compressor.

SUMMARY OF THE INVENTION

Therefore, an object of the present invention is to solve the problem of a generation of the above-mentioned inaccurate information on the capacity from a capacity detector for a variable capacity wobble plate type compressor when the capacity detector employs a sensed element made of a permanent magnet.

Another object of the present invention is to provide a variable capacity wobble plate type compressor provided with a capacity detector capable of generating highly accurate information on the current capacity condition while operating under the control of a microcomputer-including controller.

A further object of the present invention is to provide a variable capacity wobble plate type compressor provided with a capacity detector which is not adversely affected by a solenoid clutch indispensably mounted on an end of the compressor.

Thus, in accordance with the present invention, there is provided a variable capacity wobble plate type compressor including:

an outer casing having a crankcase provided with an interior for receiving a drive and a wobble plate therein, a cylinder block provided with cylinder bores in which compressing pistons reciprocate, and a rear head provided with a suction chamber for a refrigerant gas before compression and a discharge chamber for the refrigerant gas after compression, the crankcase, the cylinder block, and the rear head being axially sealingly combined together to form the outer casing;

an axially extending steel drive shaft rotatably supported by the outer casing and driven by an external drive source via a solenoid-operated clutch mounted on an end of the outer casing;

a magnetic material support member mounted on the drive shaft, to be rotated with the drive shaft, and provided with an arm portion radially projected from the support member in the crankcase interior;

a rotatable drive plate pivoted on the arm portion of the magnetic material support member and capable of changing an angle of inclination between an erect position substantially vertical to an axis of the drive shaft and a given inclined position, the drive plate supporting a non-rotatable wobble plate supported thereon to cause a wobbling of the wobble plate to thereby reciprocate the pistons at piston strokes varying in response to a change in a pressure in the crankcase interior; and a capacity detecting unit which comprises:

a permanent magnet attached to a portion of an outer periphery of the wobble plate;

a magnetic sensor fixedly attached to the crankcase of the outer casing at a position suitable for sensing an approach and departure of the permanent magnet, the magnetic sensor being capable of generating electric signals indicating the approach and departure of the permanent magnet;

a binary circuit electrically connected to the magnetic sensor, for converting the electric signals of the magnetic sensor into electric binary signals; and an arrangement wherein a magnetic flux delivered from the permanent magnet flows in a direction opposed to a magnetic flux leaking from the solenoid-operated clutch through the drive shaft, the support member, and the arm portion of the support member when the permanent magnet attached to the wobble plate is close to the magnetic sensor.

BRIEF DESCRIPTION OF THE DRAWINGS

The above and other object, features and advantages of the present invention will be made more apparent from the ensuing description of the embodiment of the present invention with reference to the accompanying drawings, wherein.

DESCRIPTION OF THE PREFERRED EMBODIMENT

The following description is of the case wherein the present invention is embodied by a variable capacity wobble plate type compressor with a solenoid-operated wobble angle control valve, used for air-conditioning a car compartment, and therefore, the compressor is driven by a car engine.

Figure 1:
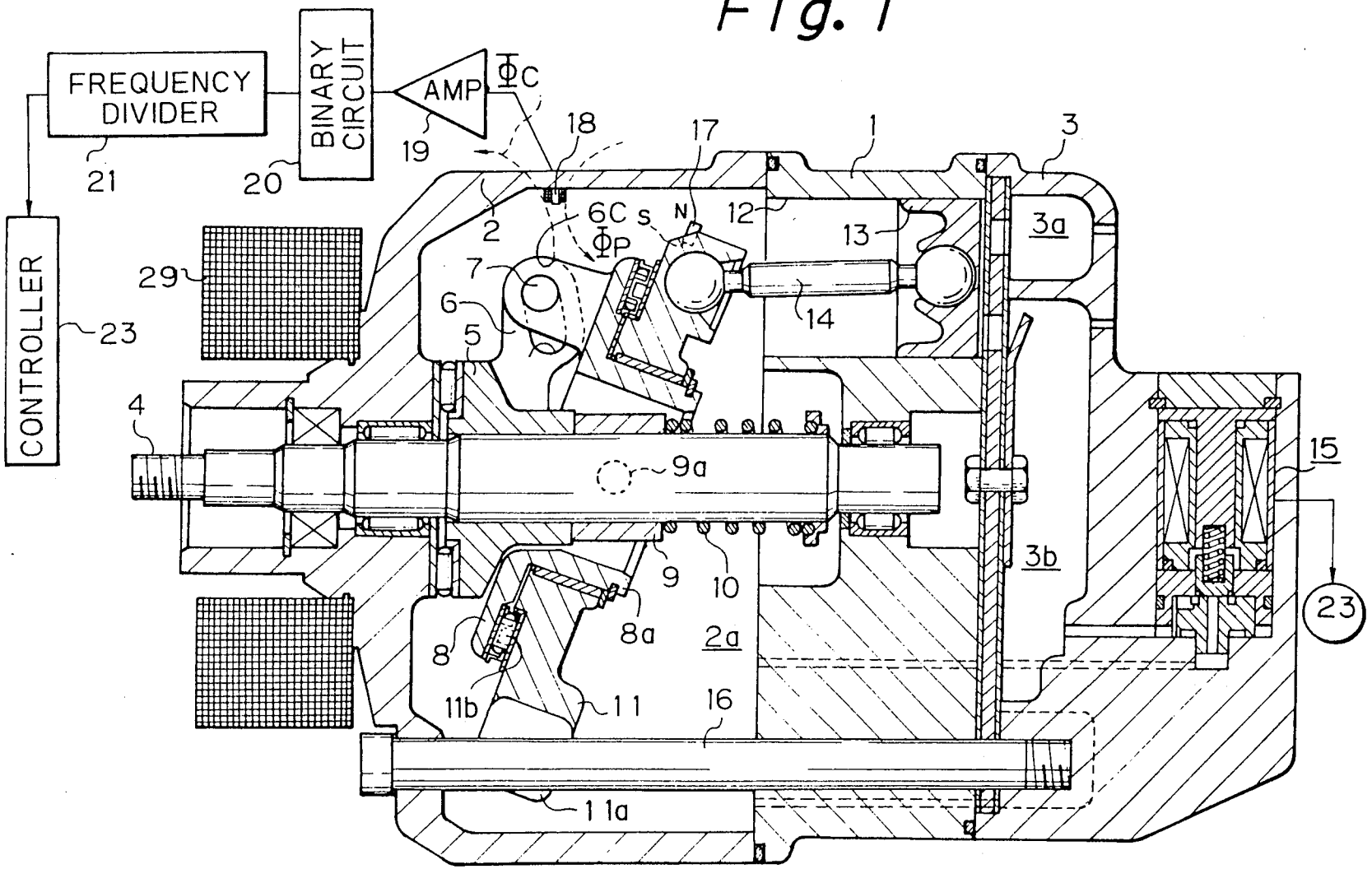
FIG. 1 is a vertical cross-sectional view of a variable capacity wobble plate type refrigerant compressor provided with a capacity detector according to an embodiment of the present invention.

Referring to FIG. 1, a variable capacity wobble plate type compressor has a cylinder block 1, a crankcase 2 and a rear head 3, which are axially sealingly combined together to form a rigid outer casing of the compressor. The cylinder block 1 and the crankcase 2 connected to a front end of the cylinder block 1 support a drive shaft 4 via front and rear bearings, to be rotated about an axis thereof. The drive shaft 4 axially extending through the inside of the cylinder block 1 and the crankcase 2 having one outer end to which a drive power is transmitted from a not-illustrated car engine, via a solenoid clutch having a solenoid element which is schematically shown and designated by a reference numeral 29. Inside the crankcase 2, a rotatable support member 5 is fixedly mounted on the drive shaft 4, and has a support arm portion 6 extending radially from the rear face of the support arm 5. The support arm portion 6 of the support member 5 is formed with a radially elongated through-hole 6*a* in which is slidably engaged a pivot pin 7 connected to a rotatable drive plate 8. The slidable engagement of the pivot pin 7 in the through-hole 6*a* elongated in a substantially radial direction in the support arm portion 6 allows an angle of inclination of the rotatable drive plate 8 to be changed from an erect position substantially vertical to the axis of the drive shaft 4. A sleeve element 9 is slidably mounted on the drive shaft 4 at a position adjacent to a rear end of the support member 5 and is constantly urged toward the rear end of the support member 5 by a coil spring 10 wound around the drive shaft 4. The sleeve element 9 is provided with a pair of radial trunnions 9*a* (only one shown) at diametrically opposite positions of the sleeve member 9, which trunnions 9*a* are engaged in not-illustrated engaging holes of the rotatable drive plate 8 to thereby permit the drive plate 8 to turn thereabout when an angle of inclination thereof is changed.

A generally circular wobble plate 11 is supported on the drive plate 8 via an annular thrust bearing 11*b* seated on the rear face of the drive plate 8, and is provided, at a portion of the periphery thereof, with a cutout 11*a* in which a fixedly arranged long bolt 16 is engaged to prevent a self-rotation of the wobble plate 11 but permit a slide motion along the fixed long bolt 16 during the rotation of the drive shaft 4 and the drive plate 5. The wobble plate 11 is engaged with a plurality of pistons 13 by connecting rods 14, each having balls at both ends thereof. The plurality of pistons 13 are slidably fit in a plurality of axial cylinder bores 12 formed in the cylinder block 1, respectively. Therefore, when the drive shaft 4 is driven, the rotation of the drive shaft 4 together with the drive plate 8 is converted into a wobbling motion of the wobble plate 11, which causes a reciprocatory sliding of each of the plurality of pistons 13 in the respective cylinder bores 12 to carry out a suction of refrigerant gas from a suction chamber 3*a* in the rear head 3 into the cylinder bores 12, a compression of the sucked refrigerant gas within the cylinder bores 12, and a discharge of the compressed gas from the respective cylinder bores 12 into a discharge chamber 3*b* formed in the rear head 3. During the compression of the refrigerant gas, a pressure prevailing in an interior 2*a* of the crankcase 2 and a pressure of the refrigerant gas sucked from the suction chamber 3*a* into the cylinder bores 12 act on both ends of each of the respective pistons 13, and therefore, a stroke of the reciprocatory slide of each piston 13 is changed in accordance with a pressure differential between the above-mentioned two pressures, and accordingly, an angle of inclination of the wobble plate 11 is changed. The pressure level in the interior 2*a* of the crankcase 2 is controlled by a solenoid-operated control valve in a known manner as disclosed in, for example, U.S. Pat. No. 4,747,754, by taking a cooling load into account.

Figure 2A:
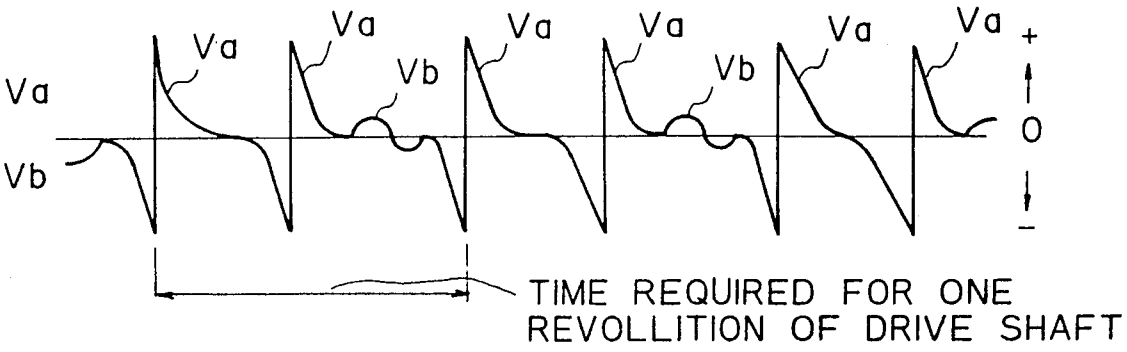
FIGS. 2A through 2C are diagrams illustrating wave forms of electric signals generated by elements and circuits of the capacity detector of FIG. 1.

The wobble plate 11 has a permanent magnet 17 as a sensed element of a later described capacity detector, and the permanent magnet 17 is embedded in a portion of the periphery of the wobble plate 11. Further, a magnetic sensor 18 as a sensing element of the capacity detector is fixedly attached to an inner wall of the crankcase 2 at a position at which the magnetic sensor 18 is able to magnetically cooperate with the permanent magnet 17 during a wobbling of the wobble plate 11. Namely, the magnetic sensor 18 is arranged to magnetically sense the approach and departure of the permanent magnet 17 in an axial direction when the wobble plate 11 wobbles at a given angle of inclination in response to a rotation of the drive shaft 4. Although only schematically illustrated, the magnetic sensor 18 per se comprises a magnetic core and a magnetic induction coil. Note; in the illustrated embodiment, the permanent magnet 17 has a south pole (S pole) at an end embedded in the wobble plate and a north pole (N pole) at an outer end thereof. Each time when the permanent magnet 17 axially moves toward and away from the magnetic sensor 18 during the wobbling of the wobble plate 11, a magnetic flux designated by Φp delivered from the N pole of the permanent magnet 17 passes through the magnetic sensor 18, while changing the density thereof. Therefore, during one revolution of the drive shaft 4, the magnetic sensor 18 sensing the approach and departure of the permanent magnet 17 generates a valid electric voltage signal Va twice, in response to a change in the density of the magnetic flux Φp. A wave shape, i.e., a saw-toothed wave shape, of the valid electric voltage signal Va is illustrated in FIG. 2A.

The compressor of FIG. 1 is also provided with the solenoid 29 of the electro-magnetic clutch, at the outer end of the outer casing of the compressor and surrounding the drive shaft 4, and the electro-magnetic clutch provides a mechanical connection between the drive shaft 4 and the car engine via an appropriate power transmitting mechanism, such as a belt and pulley mechanism, and a disconnection therebetween depending on energization and de-energization of the solenoid 29. While solenoid 29 of the clutch is electro-magnetically energized to connect the drive shaft 4 of the compressor to the car engine, a magnetic flux Φc leaks from the solenoid 29 and circulates through the drive shaft 4 made of steel and the support arm portion 6 of the support member 5 also made of steel, until it returns to the solenoid 29, and as a result, an end 6*c* of the support arm 7 becomes a magnetic pole. Therefore, during the rotation of the support arm portion 6 of the support member 5, when the end 6*c* of the support arm portion 6 circumferentially passes the magnetic sensor 18, the magnetic flux Φc delivered from the end 6*c*, i.e., the magnetic pole, of the support arm portion 6 passes through the magnetic core of the magnetic sensor 18 while crossing the magnetic coil of the magnetic sensor 18. Accordingly, each time the magnetic sensor 18 senses the approach and departure of the end 6*c* of the support arm portion 6 during the rotation of the support member 5, the sensor 18 generates an invalid electric voltage signal Vb having a round wave form as illustrated in FIG. 2A, in response to a change in the density of the magnetic flux Φc. Namely, during one revolution of the drive shaft 4 and the support member 5, one invalid electric alternative current (AC) voltage signal Vb is generated by the magnetic sensor 18 in response to the change in the density of the magnetic flux Φc.

Figure 2B:
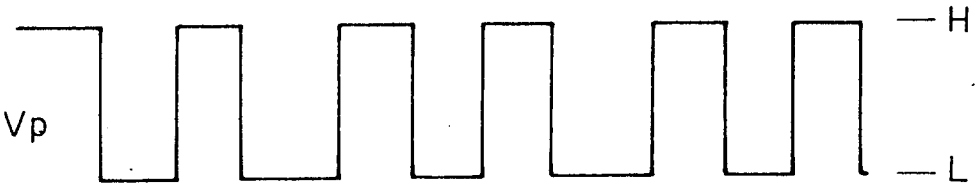
Figure 2C:
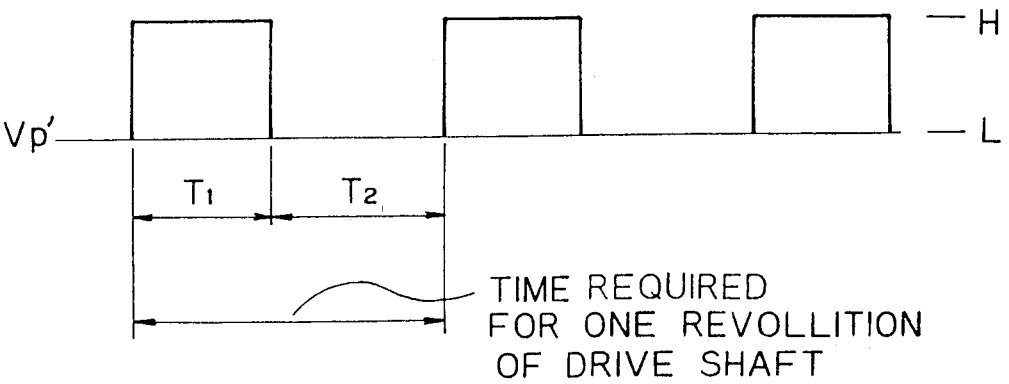
Figures 3A, 3B, 3C:
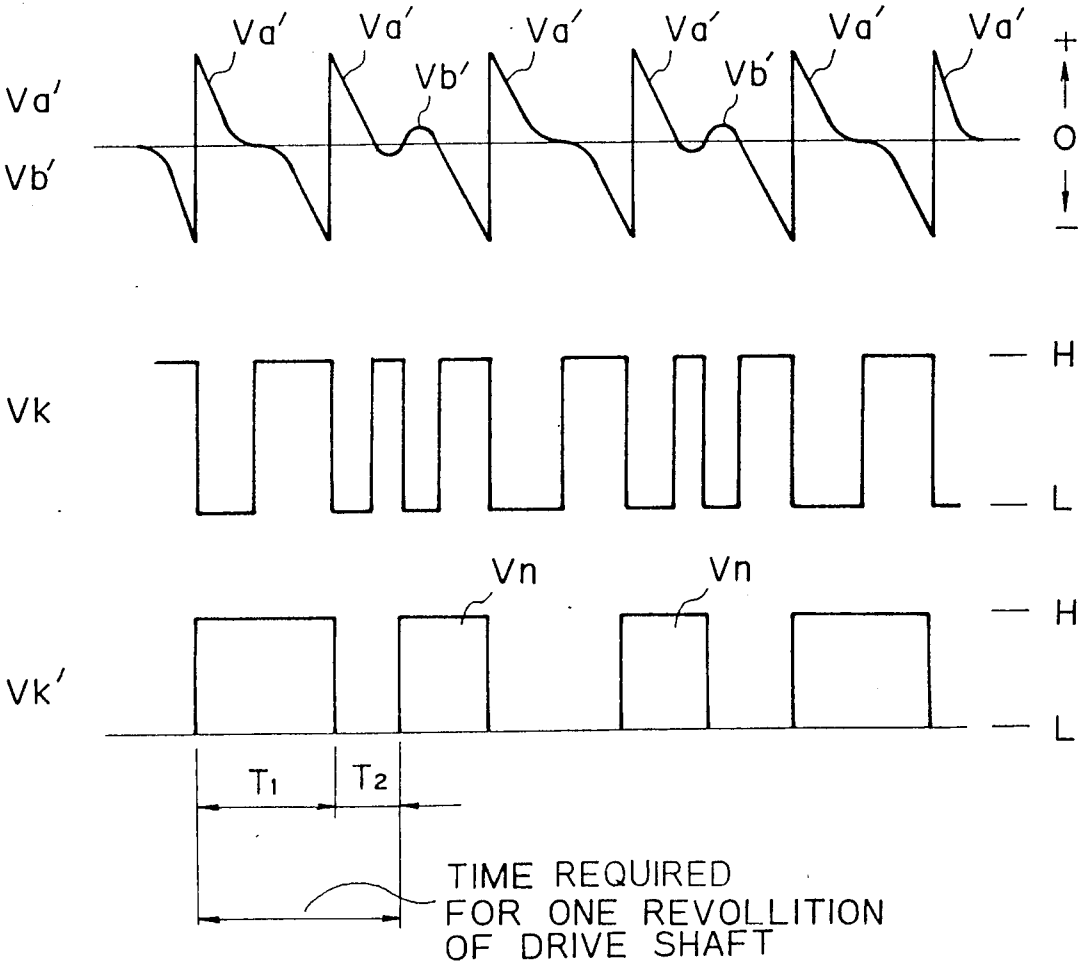
Fig. 3A PRIOR ART
Fig. 3B PRIOR ART
Fig. 3C PRIOR ART
FIGS. 3A through 3C are diagrams illustrating wave forms of electric signals generated by elements and circuits of the capacity detector according to the prior art.

The valid and invalid electric voltage signals Va and Vb are sent to an amplifier 19, by which both voltage signals Va and Vb are amplified, and then sent to a binary circuit 20 by which the amplified voltage signals Va and Vb are subjected to an electric binary conversion with respect to a threshold level corresponding to an electric zero voltage level, to thereby obtain electric pulsive signals Vp as illustrated in FIG. 2B. The electric pulsive signals Vp are then sent to a frequency divider 21 by which the electric pulsive signals Vp are subjected to a frequency division to obtain the output pulsive signals Vp, illustrated in FIG. 3C. Namely, the amplifier 19, the binary circuit 20, and the frequency divider 21 are elements of the capacity detector according to the present embodiment. In the described embodiment, since an arrangement of the permanent magnet 17 i.e., the sensed element of the capacity detector, and the solenoid 29 of the electro-magnetic clutch is such that the valid electric voltage signals Va and the invalid electric voltage signals Vb have respective electrical phases different from one another by 180 degrees, i.e., the electrical phase of the valid signal Va has an inverse relationship with that of the invalid signal Vb, then as understood from FIG. 2A, during one revolution of the drive shaft 4, the invalid electric voltage signal Vb is between a zero level and a positive value level after the valid electric voltage signal Va is reduced from a positive value level to a zero level. Accordingly, since the zero threshold level is crossed by neither the valid signal Va nor the invalid signal Vb, the level of the pulsive signal Vp generated by the binary circuit 20 is not changed, as understood from FIG. 2B. Subsequently, while the invalid signal Vb is between the zero and negative value levels, the valid signal Va does not cross a zero threshold level, and thus a level change of the pulsive signal Vp generated by the binary circuit 20 does not occur. As a result, according to the present embodiment, and as understood from a comparison of FIG. 2C with FIG. 3C, an erroneous pulse signal does not appear in the pulsive signals Vp' generated by the frequency divider 21, regardless of the level of the magnetic flux Φc leaking from the solenoid 29 of the electro-magnetic clutch.

The pulsive signals Vp' are sent to a microcomputer-including controller 23 for detecting a current capacity of the compressor by calculating a ratio $T_1/T_2$.

In the capacity detector of the foregoing embodiment of the present invention, the binary circuit 20 carries out a binary conversion of the electric voltage signal Va and Vb with respect to the zero threshold level, but the threshold level corresponding to a zero electric voltage level may be changed to correspond to a different appropriate electric voltage value by taking the levels of the valid and invalid electric voltage signals Va and Vb into account. For example, the binary circuit 20 may be composed of a Schmidt trigger circuit having two different threshold levels and exhibiting a hysteresis motion.

From the foregoing description it will be understood that, according to the present invention, the capacity detector of a variable capacity wobble plate type compressor comprises a permanent magnet attached to a portion of the periphery of the wobble plate, a magnetic sensor fixedly attached to an inner wall of the crankcase and sensing a movement of the permanent magnet during a wobbling of the wobble plate, a binary circuit carrying out an electric binary conversion of the electric voltage signals into corresponding binary signals, and an arrangement wherein the permanent magnet and a solenoid of the electro-magnetic clutch mounted on an outer end of the compressor casing are arranged in such a manner that the magnetic flux delivered from the permanent magnet is directed in an opposite direction to that of the magnetic flux leaking from the solenoid of the electro-magnetic clutch and flowing through the drive shaft and support member made of steel, at a region adjacent to the magnetic sensor. Therefore, during the operation of the compressor, the magnetic flux leaking from the solenoid of the electro-magnetic clutch does not adversely affect the capacity detecting operation of the capacity detector, and therefore, does not allow the generation of erroneous information on the current capacity of the compressor, by the capacity detector. Accordingly, an accurate detection of the current capacity of the compressor can be obtained from the capacity detector of the present invention.

We claim:

1. A variable capacity wobble plate type compressor including:

an outer casing having a crankcase provided with an interior for receiving a drive and a wobble plate therein, a cylinder block provided with cylinder bores in which compressing pistons reciprocate, and a rear head provided with a suction chamber for a refrigerant gas before compression and a discharge chamber for the refrigerant gas after compression, the crankcase, the cylinder block, and the rear head being axially sealingly combined together to form the outer casing;

an axially extending steel drive shaft rotatably supported by the outer casing and driven by an external drive source via a solenoid-operated clutch mounted on an end of the outer casing;

a magnetic material support member mounted on the drive shaft to be rotated with the drive shaft and provided with an arm portion radially projected from the support member in the crankcase interior;

a rotatable drive plate pivoted on the arm portion of the magnetic material support member and capable of changing an angle of inclination between an erect position substantially vertical to an axis of the drive shaft and a given inclined position, the drive plate supporting a non-rotatable wobble plate supported thereon to cause a wobbling of the wobble plate to thereby reciprocate the pistons at piston strokes varying in response to a change in a pressure in the crankcase interior; and a capacity detecting means which comprises:

a permanent magnet attached to a portion of an outer periphery of the wobble plate;

a magnetic sensor fixedly attached to the crankcase of the outer casing at a position suitable for sensing an approach and departure of the permanent magnet, the magnetic sensor being capable of generating electric signals indicating the approach and departure of the permanent magnet;

a binary circuit electrically connected to the magnetic sensor, for converting the electric signals of the magnetic sensor into electric binary signals; and an arrangement wherein a magnetic flux delivered from the permanent magnet flows in a direction opposite to that of a magnetic flux leaking from the solenoid-operated clutch through the drive shaft, the support member, and the arm portion of the support member when the permanent magnet attached to said wobble plate is close to the magnetic sensor.

2. A variable capacity wobble plate type compressor according to claim 1, wherein said permanent magnet is attached to said portion of the outer periphery of said wobble plate in such a manner that, when said wobble plate wobbles, said permanent magnet axially approaches and departs from said magnetic sensor.

3. A variable capacity wobble plate type compressor according to claim 2, wherein said magnetic sensor comprises a magnetic core, and a solenoid arranged around said magnetic core and able to electro-magnetically cooperate with said permanent magnet.

4. A variable capacity wobble plate type compressor according to claim 1, wherein said permanent magnet has one end embedded in said portion of the outer periphery of said wobble plate and acting as one magnetic pole thereof, and another end projected from said portion of the outer periphery of said wobble plate and acting as the other magnetic pole.

* * * * *